United States Patent [19]

Suzuki et al.

[11] Patent Number: 4,553,648

[45] Date of Patent: Nov. 19, 1985

[54] EXHAUST BRAKE APPARATUS OF SLIDING TYPE

[75] Inventors: Isao Suzuki; Kenichi Abe, both of Higashimatsuyama, Japan

[73] Assignee: Jidosha Kiki Co., Ltd., Tokyo, Japan

[21] Appl. No.: 630,489

[22] Filed: Jul. 13, 1984

[30] Foreign Application Priority Data

Aug. 3, 1983 [JP] Japan ..... 58-121114[U]

[51] Int. Cl.[4] ..... F02D 9/06

[52] U.S. Cl. ..... 188/273; 123/323; 188/154

[58] Field of Search ..... 188/273, 154, 272, 270; 123/320, 321, 322, 323, 324; 60/280, 324

[56] References Cited

U.S. PATENT DOCUMENTS

| | | | |
|---|---|---|---|
| 3,947,073 | 3/1976 | Cattaneo et al. | 188/273 X |
| 4,061,215 | 12/1977 | Ishikawa | 188/273 X |
| 4,205,704 | 6/1980 | Benson | 188/273 X |
| 4,211,312 | 7/1980 | Nogami et al. | 188/273 |
| 4,380,971 | 4/1983 | Thulen et al. | 188/273 X |
| 4,408,627 | 10/1983 | Harris | 123/323 X |

*Primary Examiner*—Douglas C. Butler
*Attorney, Agent, or Firm*—Flynn, Thiel, Boutell & Tanis

[57] ABSTRACT

An exhaust brake apparatus of sliding type is provided including a main valve which is adapted to open or close an exhaust gas passage. The main valve is formed with a vent hole which provides a communication thereacross through the exhaust gas passage. A sub-valve which operates to open or close the vent hole is connected through an operating rod to an actuator. When the exhaust gas passage is to be closed, the sub-valve is caused to close the vent hole before the main valve is operated while when the exhaust gas passage is to be opened, the sub-valve is moved out of its position closing the vent hole before the main valve is operated. In accordance with the invention, the main valve is formed with a plurality of vent holes, which are individually opened or closed by a plurality of sub-valves mounted on the operating rod. In this manner, an increased area of flow path through the vent holes is achieved without increasing the stroke of the operating rod or increasing the size of the sub-valves.

3 Claims, 2 Drawing Figures

EXHAUST BRAKE APPARATUS OF SLIDING TYPE

FIELD OF THE INVENTION

The invention relates to an exhaust brake apparatus of sliding type, and more particularly, to such apparatus including a main valve which operates to open or close an exhaust gas passage and which is formed with vent hole for an exhaust gas, which is in turn associated with and is opened or closed by sub-valve.

DESCRIPTION OF THE PRIOR ART

In an exhaust brake apparatus of sliding type as mentioned above, the sub-valve is mechanically coupled with an operating rod of an actuator to allow the vent hole to be closed before the main valve is operated in a direction to close the exhaust gas passage and to allow the vent holes to be opened to reduce the pressure differential across the main valve before operating the main valve in a direction to open the exhaust gas passage.

It will therefore be seen that an improvement in the operational response of such exhaust brake apparatus, in particular, during the opening operation thereof, requires that the pressure differential across the main valve be reduced to a given value within a short time interval after the opening of the vent hole by the sub-valve, or in other words, that the vent hole having a relatively large area for the flow path therethrough be formed. However, with a conventional arrangement, there has been a limit in assuring an increased for the flow path. Specifically, if the size of the vent hole is increased as viewed in a direction in which the sub-valve is operated, there results an increased stroke between the opening of the sub-valve and the opening of the main valve, and accordingly an improvement in the operational response cannot be expected. On the other hand, increasing the size of the vent hole in a direction orthogonal to the direction of operation of the sub-valve gives rise to a problem of poor hermetic seal of the sub-valve which may occur as a result of thermal deformation.

SUMMARY OF THE INVENTION

In view of the foregoing, it is an object of the invention to enable an improvement in the operational response of an exhaust brake apparatus of sliding type without accompanying an increased stroke or a problem of thermal deformation of the sub-valve, as mentioned above.

In accordance with the invention, the main valve is formed with a plurality of vent holes, which may be opened or closed by sub-valves which are couple to an operating rod of an actuator. In this manner, an increased area for the flow path can be secured as compared with the prior arrangement without increasing the stroke of the operating rod and without increasing the size of sub-valves to an extent that the latter may be greatly influenced by the thermal deformation. As a result the operational response of the exhaust brake apparatus can be improved.

Above and other objects, features and advantages of the invention will become apparent from the following description with reference to the attached drawings.

DESCRIPTION OF EMBODIMENT

Figure 1:
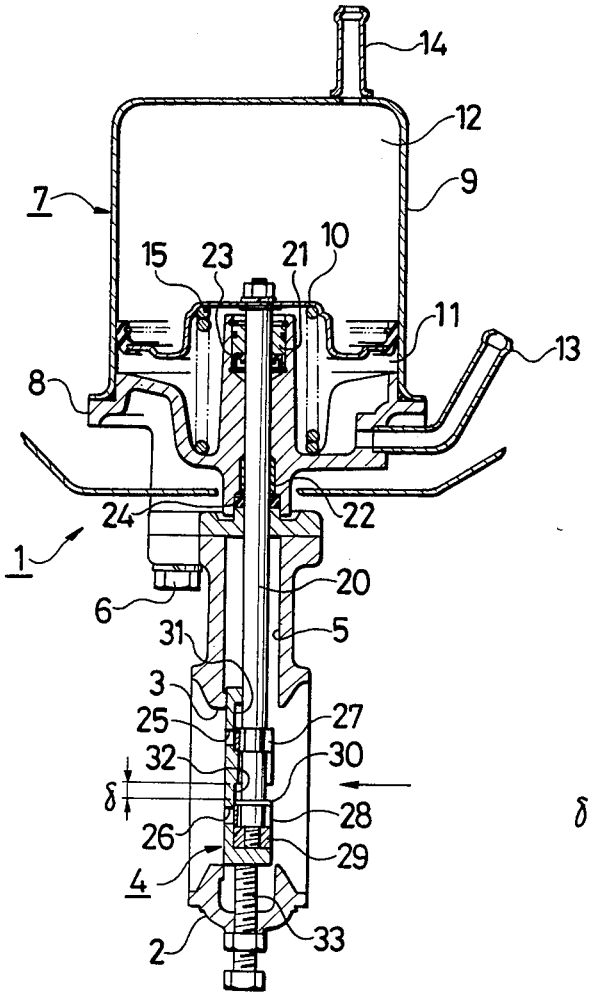
FIG. 1 is a longitudinal section of one embodiment of the invention.

Referring to the drawings, an exhaust brake apparatus 1 of sliding type includes a valve body 2 which is disposed within an exhaust pipe, not shown, intermediate its length. The valve body 2 is formed with an exhaust gas passage 3 which permits an exhaust gas flowing through the exhaust pipe to pass therethrough. The valve body is also formed with a chamber 5, which extends in a direction orthogonal to the exhaust gas passage 3 to receive a main valve 4 therein. The main valve 4 is reciprocable along a sliding surface, which is located downstream, as viewed in the direction of a flow of exhaust gas indicated by an arrow in FIG. 1. The main valve closes the exhaust gas passage 3 when it is positioned therein, and when it is removed out of the exhaust gas passage 3, permits a free flow of the exhaust gas, thus releasing the exhaust braking action.

The valve body 2 is connected to a cover 8 of an actuator 7 by means of a bolt 6. A cylinder 9 having a closed bottom and secured to the cover 8 receives a power piston 10 therein, which is slidably fitted therein to divide the interior of the cylinder into a negative pressure chamber 11 and an atmospheric pressure chamber 12. The negative pressure chamber 11 communicates with a source of negative pressure through an inlet 13 formed so as to extend through the cover 8 and through a solenoid valve, not shown, while the atmospheric pressure chamber 12 communicates with the atmosphere through a vent hole 14 formed in the cylinder 9 and an air cleaner, not shown. A compression spring 15 is disposed within the negative pressure chamber to urge the power piston 10 normally to its non-operative position.

The power piston 10 has a shank which is integrally connected to one end of an operating rod 20, which extends through guide bushings 21, 22 and seal members 23, 24, both of which are disposed on the upper and the lower sides of the cover 8, the rod projecting into the valve body 2. The other end of the rod 20 carries a pair of sub-valves 27, 28 which cooperate with a pair of vent holes 25, 26 formed in the main valve 4.

The vent holes 25, 26 are spaced apart a given distance, and adjacent to the other end, the operating rod 20 is formed with a pair of portions of reduced diameter which are spaced apart by the same distance as the distance between the vent holes. Each of the sub-valves 27, 28 is centrally formed with a groove which is adapted to fit around the reduced diameter portion of the operating rod. In this manner, the sub-valves 27, 28 are coupled with the operating rod 20 through the groove so that the both sub-valves 27, 28 are integrally coupled together as viewed in the direction in which the operating rod 20 is operated while allowing their relative movement in a direction corresponding to the flow of the exhaust gas. Accordingly, the both sub-valves 27, 28 are urged by gas pressures and are maintained in a sliding contact with the sliding surface on the main valve 4. In the embodiment shown, the lower sub-valve 28 is fitted around the reduced diameter portion of the operating rod 20 intermediate an oblong nut 29 threadably engaged with the lower end of the rod 20 and an oblong washer plate 30 which is fitted around the reduced diameter portion.

It will be noted that the main valve 4 is formed with a pair of recesses 31, 32, and each of the sub-valves 27, 28 is mounted on the operating rod 20 within a separate recess. In the embodiment shown, the nut 29 can abut against one of walls which define the recess 32 while the washer plate 30 can against the opposite wall of the recess 32, thus coupling the operating rod 20 and the main valve 4 together for integral movement. It will be seen that a relative displacement of magnitude $\delta$ is permitted between the operating rod 20 and the sub-valves 27, 28 on one hand and the main valve 4 on the other. At either end of such displacement, the sub-valves open or close the vent holes 25, 26.

Figure 2:
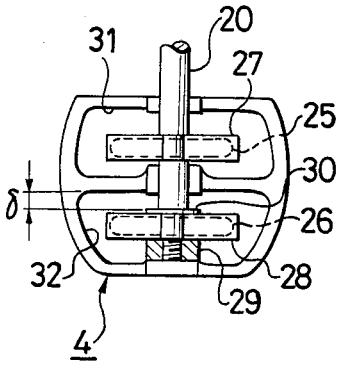
FIG. 2 is a fragmentary front view, partly in section, of the arrangement in FIG. 1.

In FIGS. 1 and 2, numeral 33 represents a stop which is threadably engaged with the valve body 2 to define the closed position for the main valve 4.

In operation, as a negative pressure is introduced into the negative pressure chamber 11 of the actuator 7 when the arrangement assumes its non-operative condition, both the power piston 10 and the operating rod 20 are driven forward against the resilience of the spring 15, initially causing the sub-valves 27, 28 to slide along the main valve 4. When the nut 29 engaged with the free end of the operating rod 20 abuts against the wall of the recess 32 in the main valve 4, the both sub-valves 27, 28 are located to close the vent holes 25, 26 formed in the main valve. At the same time, the main valve 4 is driven forward as the operating rod 20 moves forward. When the main valve 4 moves forward to a position where it abuts against the stop 33, it substantially closes the exhaust gas passage 3, thus achieving a desired exhaust braking action (as shown by the condition illustrated in FIG. 1).

When the atmospheric pressure is now introduced into the negative pressure chamber 11, the combination of the power piston 10 and the operating rod 20 is driven backward by the resilience of the spring 15. Again, the sub-valves 27, 28 are driven backward relative to the main valve 4 which remains stationary, thus opening the vent holes 25, 26. This reduces the pressure differential of the exhaust gas across the main valve 4. Subsequently when the washer plate 30 abuts against the wall of the recess 32 in the main valve 4, the latter retracts together with the operating rod 20, thus opening the exhaust gas passage 3.

The provision of the pair of sub-valves 27, 28 to open the vent holes 25, 26 in the embodiment described above allows the area of flow path to be increased as much as twice the area obtained with the conventional apparatus having a single sub-valve cooperating with a single vent hole, without increasing the stroke of the operating rod 20 or without unduly increasing the size of the vent holes 25, 26. Accordingly, when the vent holes 25, 26 are opened, the pressure prevailing upstream of the main valve 4 can be rapidly reduced, thus allowing the operational response of the exhaust brake apparatus to be improved.

While the invention has been shown and described above in connection with an embodiment thereof, it should be understood that a number of changes and modifications will readily occur to one skilled in the art without departing from the scope and spirit of the invention as defined by the appended claims.

What is claimed is:

1. An exhaust brake apparatus of sliding type including a valve body which slidably receives a main valve therein for opening or closing an exhaust gas passage, a vent hole formed in the main valve to permit a communication thereacross through the exhaust gas passage, a sub-valve disposed on the main valve so as to be capable of relative displacement within a limited extent thereto for opening or closing the vent hole, and an actuator including an operating rod which drives the sub-valve, the arrangement being such that whenever the exhaust gas passage is to be closed, the main valve is driven to close the exhaust gas passage while simultaneously causing the sub-valve to close the vent and whenever the exhaust gas passage is to be opened, the sub-valve is moved out of its position closing the vent hole before the main valve is driven;

characterized in that the main valve is formed with a plurality of vent holes, which are individually opened or closed by a plurality of sub-valves mounted on the operating rod.

2. An exhaust brake apparatus according to claim 1 in which each of the sub-valves is formed with a groove which is fitted around a reduced diameter portion of the operating rod so as to couple the sub-valves together for integral movement in the axial direction of the operating rod while permitting a displacement of the sub-valve with respect to the main valve, as viewed in the direction of the exhaust gas passage.

3. An exhaust brake apparatus according to claim 2 in which one of the sub-valves which is located on the extreme end of the operating rod is disposed between a washer plate fitted around the operating rod and a nut threadably engaged with the extreme end of the operating rod.

* * * * *